US005759414A

United States Patent [19]

Wilkes et al.

[11] Patent Number: 5,759,414

[45] Date of Patent: Jun. 2, 1998

[54] SWIMMING POOL MAIN DRAIN ASSEMBLY

[75] Inventors: Robert D. Wilkes, Williamsburg, Va.; George J. Cooke, Pinehurst, N.C.

[73] Assignee: Essef Corporation, Chardon, Ohio

[21] Appl. No.: 745,043

[22] Filed: Nov. 7, 1996

[51] Int. Cl.[6] ..... E04H 4/12

[52] U.S. Cl. ..... 210/774; 210/169; 210/416.2; 210/805; 210/163; 4/509

[58] Field of Search ..... 4/509; 210/169, 210/163, 416.2, 774, 805

[56] References Cited

U.S. PATENT DOCUMENTS 2,073,784 3/1937 Day ..... 4/509

4,460,462 7/1984 Arneson .

4,832,838 5/1989 Stone .

5,408,706 4/1995 Barnes .

*Primary Examiner*—Robert Popovics

*Attorney, Agent, or Firm*—Pearne, Gordon, McCoy and Granger LLP

[57] ABSTRACT

A swimming pool main drain assembly comprises a cup-shaped fitting recessed in a pool bottom and having an open mouth substantially coplaner with the pool bottom. A port is provided in the fitting which communicates with the suction inlet of a circulation pump. A return port assembly is provided in the fitting which communicates with an outlet of the circulation pump. The return port assembly includes an outlet conduit which directs water in a substantially vertical direction out of the main drain and educts a portion of the pool water.

8 Claims, 2 Drawing Sheets

SWIMMING POOL MAIN DRAIN ASSEMBLY

BACKGROUND OF THE INVENTION

1. Field of the Invention

This invention relates to a main drain fitting for a swimming pool, which is adapted to withdraw water from the pool and circulate it through a filter to be returned to the pool in a filtered condition.

The main drain is further adapted to serve as an return port for the filtered water to mix the incoming and outgoing streams while maintaining a hydro-dynamic balance at the port.

2. Description of the Related Art

Typical main drain fixtures for swimming pools serve the principle function of providing access to the lowest point in the swimming pool. This access is used to provide a source of water to the filter as well as a means to completely drain the water from the pool, when required. When filtering, the water from the main drain is the only water containing heavier pool debris which sinks and migrates to the pool's lowest point. Pool cleaners, especially in-floor types, function to force all heavy pool debris from the pool floor to the main drain. Pool cleaners which feature trailing whips also will tend to disturb settled debris and aid in the migration to the pool's lowest point where the main drain is located.

While a single main drain is employed for a pool, a number of return ports are provided for incoming filtered water. The return ports are usually located adjacent the surface of the water and are employed to guide floating debris toward the pool skimmers. The water circulation system may include a heater. When a heater is employed, it is common to locate some or all of the return ports at various positions on the pool bottom to facilitate good mixing of the heated water as the heated water rises and diffuses through the cooler body of pool water. If the heated water is not introduced at the lowest point of the pool, the water develops a temperature gradient with the hottest water at the surface and the coldest water at the bottom. This situation causes the highest energy loss as hotter water evaporates faster and temperature gradients are less comfortable for the bather.

Since the main drain is connected to the suction inlet of the pool pump, there is the danger of a bather being held under water by the suction force of the drain. There is also the possibility of severe injuries if a child sits on the main drain in shallow pools. The incidents are a concern of pool owners and have encouraged development of main drain safety covers and have legislated the mandatory use of multiple main drains and secure means for drain cover attachments in commercial installations.

DESCRIPTION OF THE INVENTION

This invention provides a main drain fitting which serves to introduce water at the pool's lowest point while retaining the normal main drain functionality. The introduction of water at the main drain is particularly useful if the water is heated, since the ideal point of introduction of heated water is at or near the bottom of the pool. Particularly important in the design, according to this invention, is the fact that the incoming water hydro-dynamically balances the outlet suction at the opening of the main drain to the pool to eliminate the possibility of injuries to bathers as discussed above.

According to this invention, the main drain assembly comprises a cup-shaped fitting which is adapted to be recessed in a pool bottom. The fitting has an open mouth, substantially coplanar with the pool bottom and defines an influent port adapted to communicate with a suction inlet of a pool circulation pump. The fitting further defines a return port which is adapted to communicate with an outlet of the circulation pump. The return port assembly includes an outlet conduit which is axially located with respect to the open mouth of the fitting to direct fluid flow in a substantially vertical direction into the pool body. Return water is channeled in a downwardly directed flow path surrounding the upwardly directed flow path of the inlet fluid. The upwardly directed flow path is, in part, defined by a venturi nozzle which educts a portion of the water from the downwardly directed flow path to be mixed with the incoming water. If the incoming water is heated, this mixing action lowers the temperature of the incoming water and minimizes the flow velocity, both of which are beneficial to the efficiency in attaining a uniform pool temperature.

DETAILED DESCRIPTION OF THE INVENTION

Figure 1:
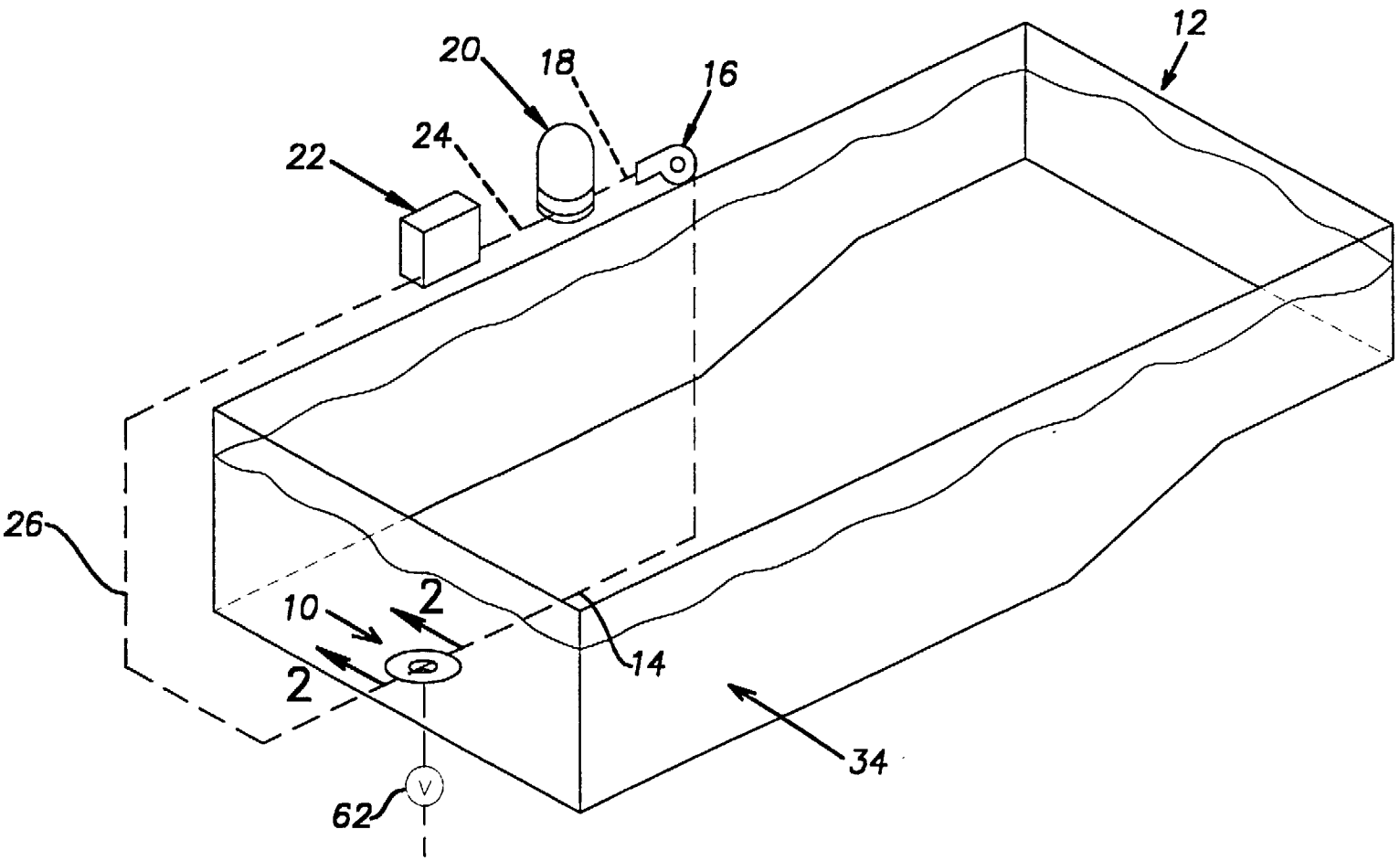
FIG. 1 is a semi-schematic perspective view of a swimming pool having a main drain according to this invention.

Referring now to FIG. 1, a main drain fitting 10 is installed in the lowest point of a swimming pool 12 so that substantially all the water may be drained from the pool when the pool is emptied. The main drain 10 is connected to a pipe 14 which serves as a pool influent conduit to a circulating pump 16. The output of the pump 16 is connected by a pipe 18 to a suitable filter 20 which may be a sand, diatomaceous earth or cartridge filter. An optional heater 22 may be connected to the output of the filter 20 by a pipe 24. If a heater 22 is employed, a conventional by-pass circuit (not shown) may be provided. The heater 22 returns heated and filtered water to the main drain 10 by a pipe 26.

Figure 2:
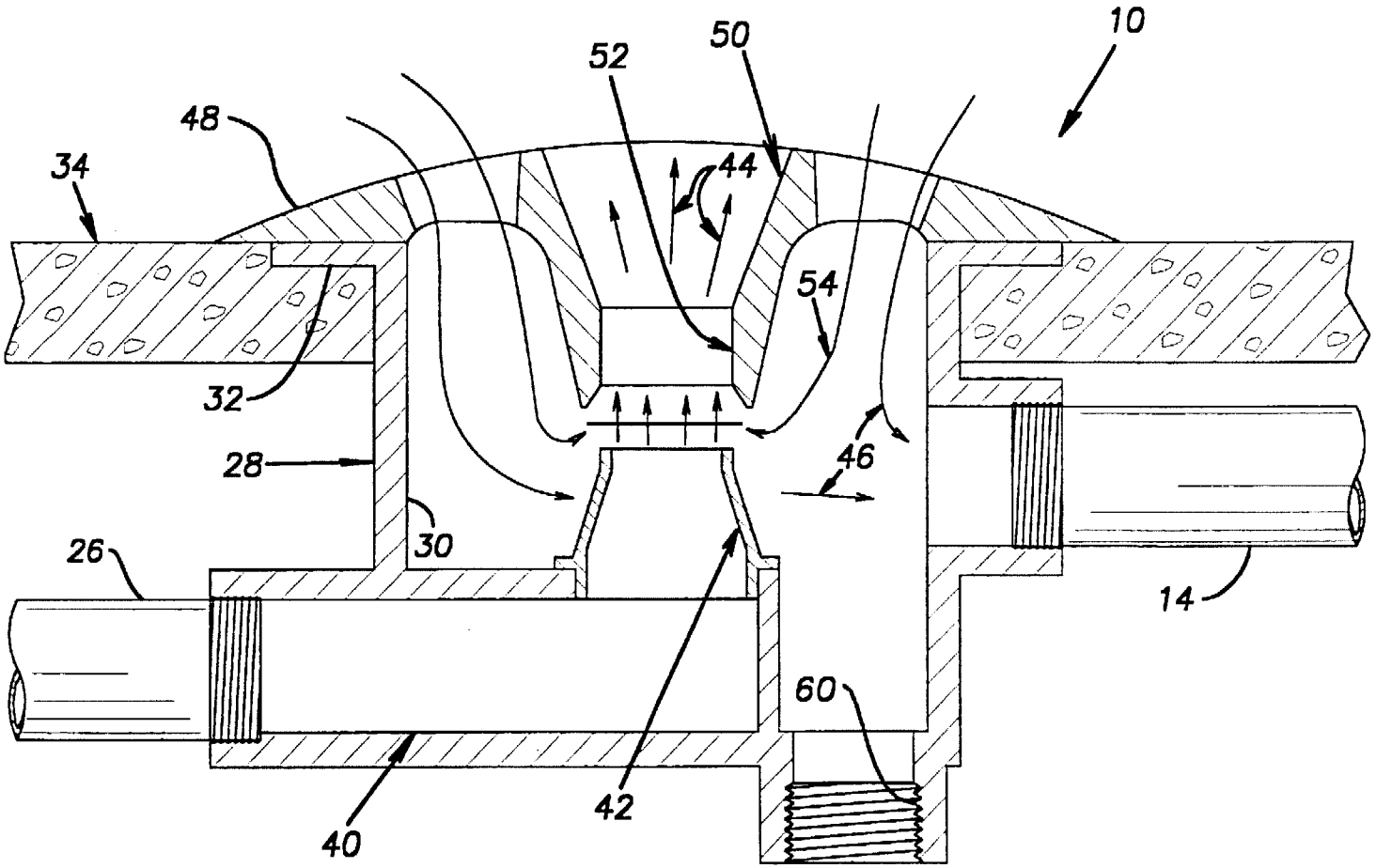
FIG. 2 is an enlarged sectional view, the plane of the section being indicated by the line 2—2 in FIG. 1.

Referring now to FIG. 2, the main drain 10 comprises a cup-shaped fitting 28 having a cylindrical side wall 30 and an upper flange 32 adapted to be recessed in a bottom-wall 34 of the pool 12. The cylindrical wall 30 defines an open mouth 36 which is substantially coplanar with the pool bottom 34. An influent port 38 is provided in the fitting 28 and the pipe 14 is threadedly connected to the port 38. The fitting 28 also includes a return port 40 which is threadedly connected to the pipe 26. An outlet nozzle 42 is connected to the inlet port 40 and directs incoming fluid flow in a substantially vertical direction as is indicated by the arrows 44 in FIG. 2. The outlet nozzle 42 is substantially axially aligned with the open mouth 36 of the cup-shaped fitting 28 to define an upwardly directed flow path of fluid from the pump 16 and, with the open mouth 36, to define a downwardly directed flow path of fluid to the inlet of the circulation pump by way of the pipe 14. The downwardly directed flow path is indicated by the arrows 46 in FIG. 2.

A perforated cover plate 48 is provided to cover the open mouth 36 and the cover plate 48 is provided with a conical recess 50. A lower end 52 of the recess 50 defines a venturi throat for the outlet nozzle 42 to educt a portion of the downwardly directed flow path of fluid as is indicated by the arrows 54.

If the incoming water to the main drain 10 is heated, the heated water is initially mixed with the relatively cool educted water. The venturi nozzle formed by the conical recess 50 also serves to lower the velocity of the upwardly-directed stream of returned water. The mixing action thus lowers the temperature of the water exiting from the drain and minimizes the flow velocity, both of which are beneficial to the efficiency in attaining a uniform pool temperature.

An axial bottom port 60 is provided for connection to a conventional hydrostatic release valve 62 (FIG. 1).

An important aspect of this invention is the fact that the water return inlet communicates with the main drain. This feature not only provides for a proper mixing of heated water, but also eliminates the problem of suction force created when the drain is completely blocked by the human body. Many states require that a plurality of main drains be provided in a pool so that alternate return paths to the pump exist in the event of complete blockage of one of the drains. According to this invention, the upward flow of the incoming water balances the downward force of the water drawn by the pump. If the drain is completely blocked by a human body, the water flow within the main drain becomes short-circuited. Thus, there will be no net suction force to entrap a bather. In fact, the warm water stream being directed upward will present a strong repelling force as a bather approaches a drain. If the main drain is plumbed so that the main drain water flow into the pool is always equal to or greater than the flow from the main drain, then the important safety feature according to this invention is preserved, even when a pool heater is not used.

The present disclosure describes several embodiments of the invention, however, the invention is not limited to these embodiments. Other variations are contemplated to be within the spirit and scope of the invention and appended claims.

What is claimed is:

1. A swimming pool main drain assembly comprising a cup-shaped fitting recessed in a pool bottom and having an open mouth substantially coplanar with the pool bottom, a port in said fitting communicating with a suction inlet of a circulation pump, a return port assembly in said fitting communicating with an outlet of said circulation pump, said return port assembly including an outlet conduit which directs fluid flow in a substantially vertical direction.

2. A swimming pool main drain assembly according to claim 1, wherein said outlet conduit is substantially axially aligned with the open mouth of said cup-shaped fitting to define an upwardly directed flow path of fluid from said outlet of said circulation pump and, with said open mouth, to define a downwardly directed flow path of fluid to said inlet of said circulation pump.

3. A swimming pool main drain according to claim 2, including a venturi nozzle axially aligned with said outlet conduit and being adapted to educt a portion of fluid from said downwardly directed flow path and inject said fluid in said upwardly directed flow path.

4. A swimming pool main drain assembly according to claim 3, wherein a perforated cover plate is provided to cover said open mouth, said cover plate having a conical recess comprising said venturi nozzle for said outlet conduit.

5. A swimming pool main drain assembly according to claim 4, wherein one end of said conical recess concentrically surrounds an end portion of said outlet conduit to define an annular eduction chamber.

6. A method of circulating water in a swimming pool having a circulating pump, a filter having an inlet connected to an outlet of said circulating pump, an inlet port connected to an outlet of said filter to deliver filtered water to said pool, and an outlet port connected to an inlet of said circulating pump comprising the steps of introducing said filtered water at a bottom of said pool in an upward stream withdrawing water from said pool in a downward stream in immediate adjacency to said upward stream, and diverting a portion of said downward stream into said upward stream.

7. A method of circulating water according to claim 6, wherein said downward stream surrounds said upward stream.

8. A method of circulating water according to claim 6, including the step of heating said upward stream.

* * * * *